US008152163B2

(12) United States Patent
Kitan

(10) Patent No.: US 8,152,163 B2
(45) Date of Patent: Apr. 10, 2012

(54) SHEET STACKING APPARATUS AND IMAGE FORMING APPARATUS

(75) Inventor: Tomonori Kitan, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 383 days.

(21) Appl. No.: 12/474,813

(22) Filed: May 29, 2009

(65) Prior Publication Data

US 2009/0295083 A1 Dec. 3, 2009

(30) Foreign Application Priority Data

May 29, 2008 (JP) ..... 2008-141059
May 13, 2009 (JP) ..... 2009-116608

(51) Int. Cl.
*B65H 31/00* (2006.01)

(52) U.S. Cl. ..... 271/207; 271/209; 271/221

(58) Field of Classification Search ..... 271/220, 271/221, 222, 224, 189, 214
See application file for complete search history.

(56) References Cited

U.S. PATENT DOCUMENTS 4,318,541 A * 3/1982 Nagel et al. ..... 271/222
4,319,744 A * 3/1982 Nagel et al. ..... 271/222
5,709,382 A * 1/1998 Shima ..... 271/209
6,196,542 B1 * 3/2001 Allmendinger ..... 271/189

FOREIGN PATENT DOCUMENTS

JP 08-127453 5/1996

* cited by examiner

*Primary Examiner* — Kaitlin Joerger
(74) *Attorney, Agent, or Firm* — Canon USA Inc IP Division

(57) ABSTRACT

A sheet stacking apparatus includes a discharging portion configured to discharge a sheet, a stacking portion configured to stack a discharged sheet, and a deforming member configured to deform the sheet to be discharged by the discharging portion, wherein the deforming member decreases a deformation amount of the sheet as a stacking amount of the sheets stacked on the stacking portion increases.

8 Claims, 11 Drawing Sheets

SHEET STACKING APPARATUS AND IMAGE FORMING APPARATUS

BACKGROUND OF THE INVENTION

1. Field of the Invention

The present invention relates to a sheet stacking apparatus which realizes good alignment property and stacking property regardless of a sheet stacking amount. Specifically, the present invention relates to a sheet stacking apparatus which is provided in an image forming apparatus, such as a copying machine, a printer, and a facsimile machine which forms an image on a sheet.

2. Description of the Related Art

As illustrated in FIG. 11, for example, in a conventional sheet stacking apparatus, a discharging portion is configured by sheet discharge rollers 301, counter rollers 302, and springs 304. Further, the counter roller 302 is supported by a counter roller holder 303. The counter roller holder 303 is urged by the spring 304 in a direction which pushes the counter roller 302 onto the sheet discharge roller 301. The other end of the spring 304 is supported by a sheet discharge frame (not illustrated). In FIG. 11, a sheet 14 is discharged.

As illustrated in FIG. 10, a stiffness applying rib 312 is a deforming member, and a spring 313 is an urging member for urging the stiffness applying rib 312 toward the sheet discharge roller 301 side. A movement of the stiffness applying rib 312 is controlled by the sheet discharge frame and the like so that the stiffness applying rib 312 can freely move only in a vertical direction, and so as not to move beyond a certain fixed height (a position higher than a nip of the sheet discharge roller 301 and the counter roller 302). The sheet discharge roller 301 and the counter roller 302 constitute the discharging portion which discharges sheets. The counter roller 302 has a kick-out protrusion 302*a* which abuts on a rear edge of a sheet to push out the sheet to be discharged (see Japanese Patent Application Laid-Open No. 08-127453).

In a conventional sheet stacking apparatus, a sheet guiding unit 312*a* of the stiffness applying rib 312 is set up at a higher position than a nip position 301*a* of the sheet discharge roller 301 and the counter roller 302, so that stiffness can be applied to the sheet to be discharged. Thus, curling of the discharged sheet in a sheet conveyance direction is decreased, so that the alignment property and the stacking property improve. More specifically, a leading edge of the discharged sheet can be prevented from hanging down and curling up on a sheet discharge tray. Further, the stiffness applying rib 312 is urged toward the sheet discharge roller 301 side by the spring 313. When a stiff sheet, such as a thick sheet of paper, passes through the discharging portion, since the stiffness applying rib 312 is lowered as far as a position where balance is maintained between the sheet stiffness and the spring 313, sheet jamming can be prevented.

As described above, the conventional technique aims to improve the alignment property and stacking property by applying stiffness to the sheet to decrease the curling in the sheet conveyance direction. However, there is a problem that the stiffness of the sheet becomes a resistance when a sheet stacking amount is close to full. More specifically, if stiffness is applied to the sheet which is discharged while rubbing an upper surface of an already stacked sheet, the resistance increases. Thus, the sheet to be discharged may be damaged or abut on the rear edge or the upper surface of the sheet already stacked on the sheet discharge tray and push that sheet out.

SUMMARY OF THE INVENTION

The present invention is directed to a sheet stacking apparatus and an image forming apparatus which realize good alignment property and stacking property regardless of a sheet stacking amount.

According to an aspect of the present invention, a sheet stacking apparatus includes a discharging portion configured to discharge a sheet, a stacking portion configured to stack a discharged sheet, and a deforming member configured to deform the sheet to be discharged by the discharging portion, wherein the deforming member decreases a deformation amount of the sheet as a stacking amount of the sheets stacked on the stacking portion increases.

According to an exemplary embodiment of the present invention, a sheet can be suitably stacked on a sheet discharge tray without curling, since stiffness is applied to the discharged sheet when a sheet stacking amount is small, and a distance from a sheet discharge port to an upper surface of the sheet stacked on the sheet discharge tray is long. Further, since stiffness is not applied to the discharged sheet when the sheet stacking amount is large, the discharged sheet is not damaged, and does not push out the already stacked sheet. Thus, image quality can be improved while providing a sheet stacking apparatus which does not often jam or break.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
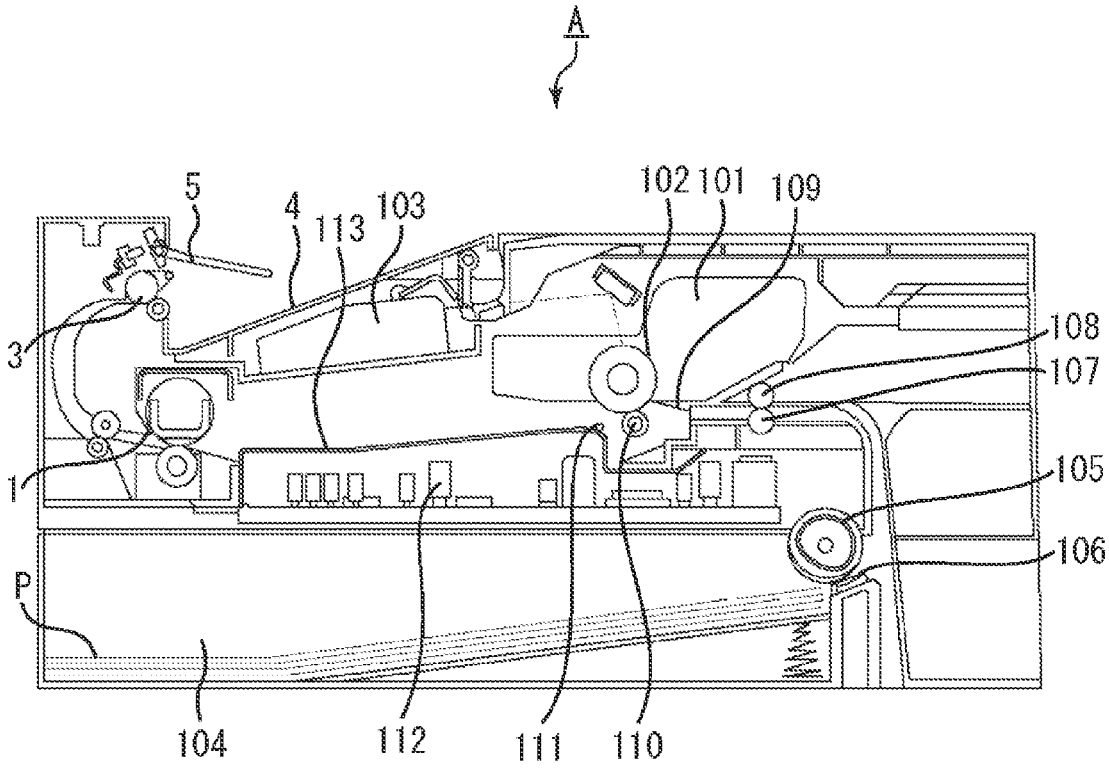
FIG. 1 is a cross sectional view of a laser printer which is an example of an image forming apparatus provided with a sheet stacking apparatus according to an exemplary embodiment of the present invention.

FIG. 1 illustrates a laser beam printer (hereafter, "laser printer") on which a process cartridge is mounted as an image forming apparatus in the present exemplary embodiment.

FIG. 1 is a cross sectional view of a laser printer A. The laser printer A is mounted with a process cartridge 101 which constitutes an image forming unit. The laser printer A forms an image by an electrophotographic method, and records the image on a sheet.

A photosensitive drum 102 as an image carrier is rotatably provided inside a frame of the process cartridge 101. A charging device and a developing unit are provided in the periphery of the process cartridge 101. The charging device uniformly charges the surface of the photosensitive drum 102. The developing unit develops a latent image formed by irradiating the charged photosensitive drum 102 with a light image based on image information and forms a visible toner image with a developing agent (hereinafter, referred to as "toner"). Further, a cleaning unit is provided for removing residual toner on a surface of the photosensitive drum 102 after the toner image is transferred onto a sheet P. These units are housed inside the frame of a cartridge. The laser printer A has a mounting mechanism for mounting the process cartridge 101 in the printer body.

An optical system 103 for irradiating the photosensitive drum 102 with the light image based on the image information is provided on an upper portion of the process cartridge 101 in the printer body.

The sheets P stored in a sheet cassette 104 are fed separately by a feeding roller 105 and a separation pad 106 which operate based on a print signal from a host computer (not-illustrated). The sheet P is inverted while passing though a curved path, and conveyed toward a rear part (the left direction in FIG. 1) of the printer body by passing through a conveyance unit configured by a conveyance roller 107 and a driven roller 108. Then, the sheet P is guided by a transfer guide 109 and conveyed to a nip portion of the photosensitive drum 102 and a transfer roller 110.

The photosensitive drum 102 is irradiated by the optical system 103 with image information from the host computer (not-illustrated) as a light image to form a latent image on the photosensitive drum 102 based on the image information. The latent image is developed by the toner to form a visible image. Further, the sheet P is conveyed to the nip portion at timing when the image formation is developed as the toner image. The toner image on the photosensitive drum 102 is transferred onto the sheet P by applying to the transfer roller 110 a voltage with a polarity reverse to the toner image formed on the photosensitive drum 102.

Immediately after passing through a transfer portion, the sheet P on which the toner image was transferred is passed directly above a static charge eliminator 111 for removing electric charge. The sheet P is then passed along a conveyance path 113 provided above an electric component 112 and conveyed to a fixing unit 1. The toner image is fixed by passing the sheet P through a nip portion of a fixing film and a pressure roller. After passing through the fixing unit 1, the sheet P is again inverted while passing through the rear portion of the printer body, and discharged onto a sheet discharge tray 4 provided as a stacking portion on an upper part of the printer body by a sheet discharge roller pair 3 constituting a discharge portion.

Figure 2:
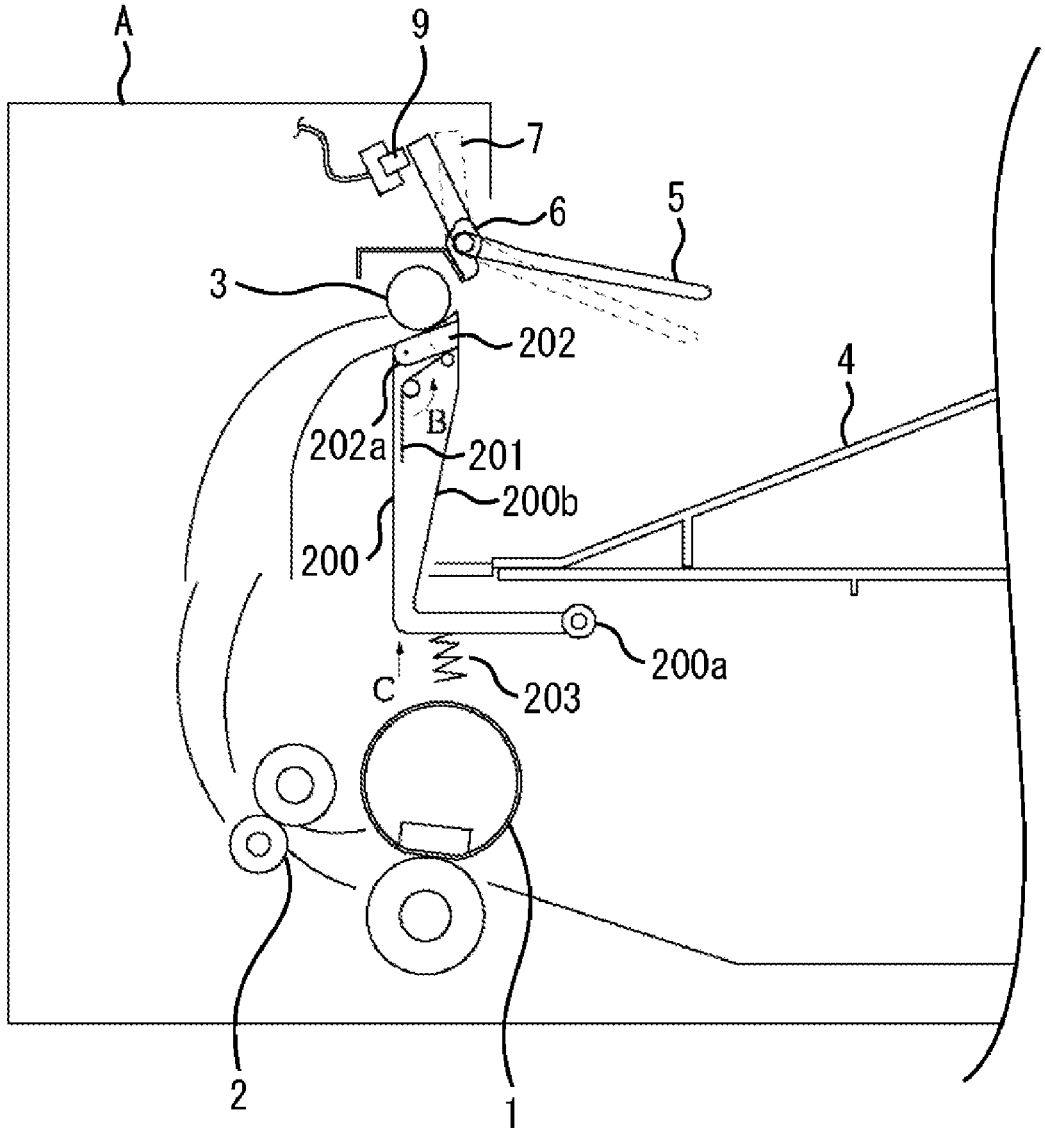
FIG. 2 is a cross sectional view illustrating the sheet stacking apparatus according to the exemplary embodiment of the present invention.

In FIG. 2, the laser printer A has a conveyance roller pair 2 which conveys the fixed and conveyed sheet P to the sheet discharge port, a full-state detection sensor lever 5 which detects a stacking height of the stacked sheets, and a sensor lever shaft 6 which is a rotational center of the full-state detection sensor lever 5. Further, the laser printer A has a sensor flag 7 which is integrally formed with the full-state detection sensor lever 5 and is provided at the other end of the full-state detection sensor lever 5, and a full-state detection sensor 9 which detects the sensor flag 7. The full-state detection sensor lever 5, the sensor flag 7, and the full-state detection sensor 9 constitute a first detection portion.

In the above configuration, the laser printer A starts a print operation based on an image output signal from the host computer (not-illustrated). The sheet P on which the image was transferred at the nip portion of the photosensitive drum 102 and the transfer roller 110 is conveyed to the fixing unit 1, and the image is fixed on the sheet P.

The sheet P is conveyed by the conveyance roller pair 2 to the sheet discharge roller pair 3. A lever 200 is rotatably supported on a rotating shaft 200a on a lower part of the sheet discharge tray 4. The lever 200 has an arm portion 200b which extends toward the upstream side (the sheet discharge roller pair 3) in a sheet discharge direction of the sheet discharge tray 4. Further, the lever 200 is urged with a predetermined force in a clockwise direction (direction of an arrow C) by a spring 203. Near the nip portion of the sheet discharge roller pair 3, a stiffness applying rib 202, which is a deforming member, is provided in a freely rotatable manner on an end of the lever 200 serving as a lever member. The stiffness applying rib 202 is urged in a direction to abut on the discharged sheet (direction of an arrow B) by an urging spring 201 which serves as an elastic member. The stiffness applying rib 202 urged by the urging spring 201 is positioned at a protruding position which protrudes into a discharge path of the sheet P by a stopper (not shown).

Figure 4:
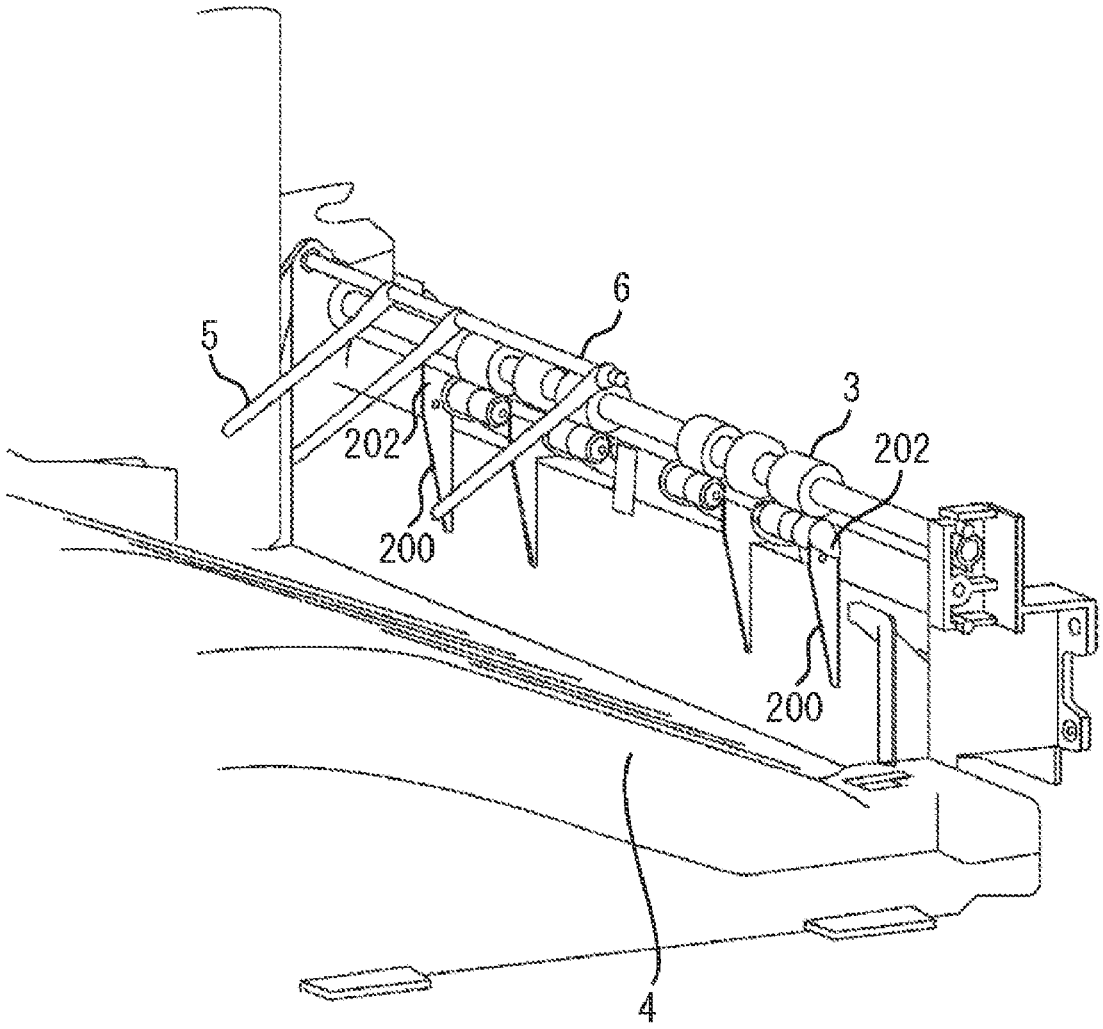
FIG. 4 is a perspective view illustrating the sheet stacking apparatus according to the exemplary embodiment of the present invention.

Further, as illustrated in FIG. 4, a plurality of the levers 200 is provided in a sheet width direction orthogonal to the sheet discharge direction of the sheet discharge roller pair 3. The stiffness applying ribs 202 are arranged on an external side of the sheet discharge roller pair 3 in the sheet width direction orthogonal to the sheet discharge direction. More specifically, the sheet P is discharged onto the sheet discharge tray 4 by the sheet discharge roller pair 3 while being deformed into a gutter (concave) shape when the edge portion of the sheet in the sheet width direction contacts the stiffness applying rib 202.

At this stage, the sheet P is discharged from the sheet discharge port so as to push up the full-state detection sensor lever 5. Thus, the discharged sheet P is stacked on the sheet discharge tray 4 to be pressed on by the full-state detection sensor lever 5. The sensor lever shaft 6 which is the rotational center of the full-state detection sensor lever 5 is arranged on the upper portion of the sheet discharge port. Although the full-state detection sensor lever 5 is integrated with the sensor flag 7, the full-state detection sensor lever 5 is constantly urged centering on the sensor lever shaft 6 toward a sheet stacking surface side of the sheet discharge tray 4 by its self-weight or a spring force. (A dotted line position 5a of the full-state sensor lever 5 in FIG. 3) Further, the urged full-state detection sensor lever 5 is positioned by a rotation stopper provided in a main body of the laser printer A.

Figure 3:
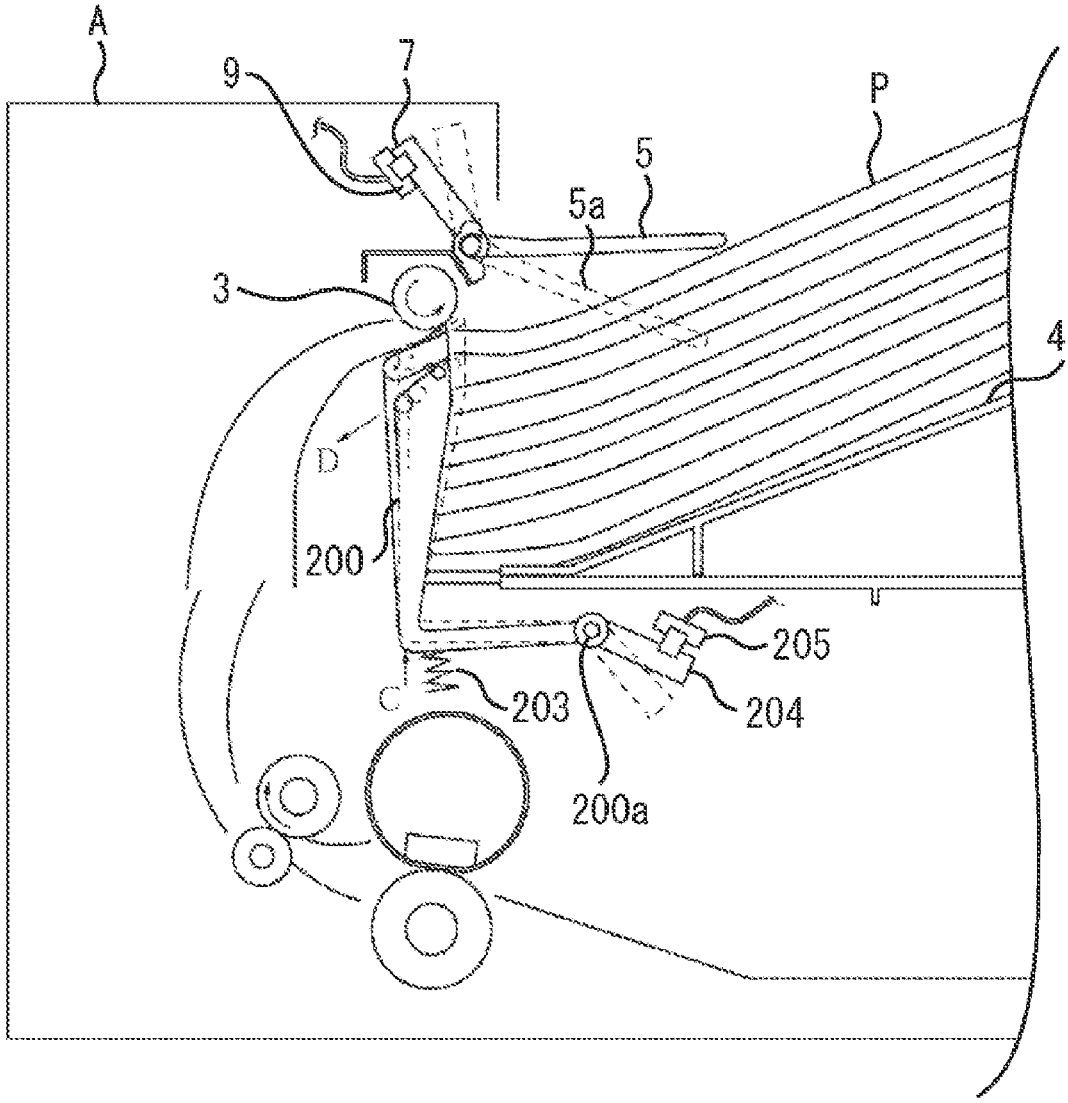
FIG. 3 is a cross sectional view illustrating the sheet stacking apparatus when sheets are fully stacked according to the exemplary embodiment of the present invention.

When the above sheet discharge is continuously performed, as illustrated in FIG. 3, the sheet P can no longer be stacked any more on the sheet discharge tray 4. This is called a "full state". During the process of reaching the full state, the arm portion 200*b* of the lever 200 which is an edge regulation portion abutting on an upstream side edge in the sheet discharge direction of the stacked sheet is pressed by the self-weight of the sheets stacked on the sheet discharge tray 4, and starts rotating in the direction of an arrow D with the rotating shaft 200*a* as the rotational center. An urging force is applied to the lever 200 by the spring 203 in the clockwise direction opposite to the arrow D to balance against the pressing force of the sheet P according to a sheet stacking amount (weight).

When the lever 200 moves to a predetermined position, a leaning detection flag 204 which is provided integrally with the lever 200 that rotates by change of a weight of the stacked sheets P blocks the lever detection sensor 205. As a result, the lever detection sensor 205 detects a movement of the lever 200 and generates a signal. The lever 200, the leaning detection flag 204, and the lever detection sensor 205 constitute a second detection portion.

The sensor flag 7 provided on one end of the full-state detection sensor lever 5 whose other end abuts on the upper surface of the sheet on the sheet discharge tray 4 rotates to a position to block light to the full-state detection sensor 9 when the stacking height of the sheets stacked on the sheet discharge tray 4 reaches a predetermined stacking height. The full-state detection sensor 9 has an infrared light emitting unit and a light receiving unit on positions facing each other, and becomes functional when light between these units is blocked. When the stacking height of the sheets stacked on the sheet discharge tray 4 reaches the predetermined stacking height which is pre-set as a stackable number of sheets, the full-state detection sensor 9 generates a signal upon detecting blocking of the light thereto, and the control unit (central processing unit (CPU)) of the main body of the laser printer A determines that the sheet stacking amount reaches the full state.

The sheet stacking amount (weight) when the movement of the lever 200 is detected is set to be approximately equal to the sheet stacking amount (height) when rotation of the full-state detection sensor lever 5 is detected. More specifically, a relationship between weight and thickness of sheets to be generally used by the image forming apparatus is calculated in advance, and detection positions of the two sensors are set so that weight and height of stacked sheets for determining the full state match with the sheet stacking amount of the calculated relationship.

Since the rotating shaft 200*a* of the lever 200 is arranged at a position distant from the sheet discharge port of the sheet discharge roller pair 3, the weight of the sheet P stacked near the sheet discharge port largely contributes to a rotational force of the lever 200 as a moment. Further, since a surface of the arm portion 200*b* of the lever 200 which abuts on the stacked sheets near the sheet stacking surface is inclined toward the sheet discharge tray 4, an effect of the moment on the rotational force of the lever 200 is small when the sheet stacking amount is small.

Further, the sheet stacking surface of the sheet discharge tray 4 is inclined at a portion near the sheet discharge port and horizontal at a portion farther away from the sheet discharge port, so that a horizontal component of the weight of the stacked sheets on the inclined portion of the sheet discharge tray 4 acts as the rotational force of the lever 200. Therefore, the rotational force generated against the lever 200 can be set to be roughly the same as a sheet having a length which does not exceed the inclined portion of the sheet discharge tray 4 (e.g., A4 size) even when a sheet has a length which exceeds the inclined portion of the sheet discharge tray 4 (e.g., A3 size).

Figure 5:
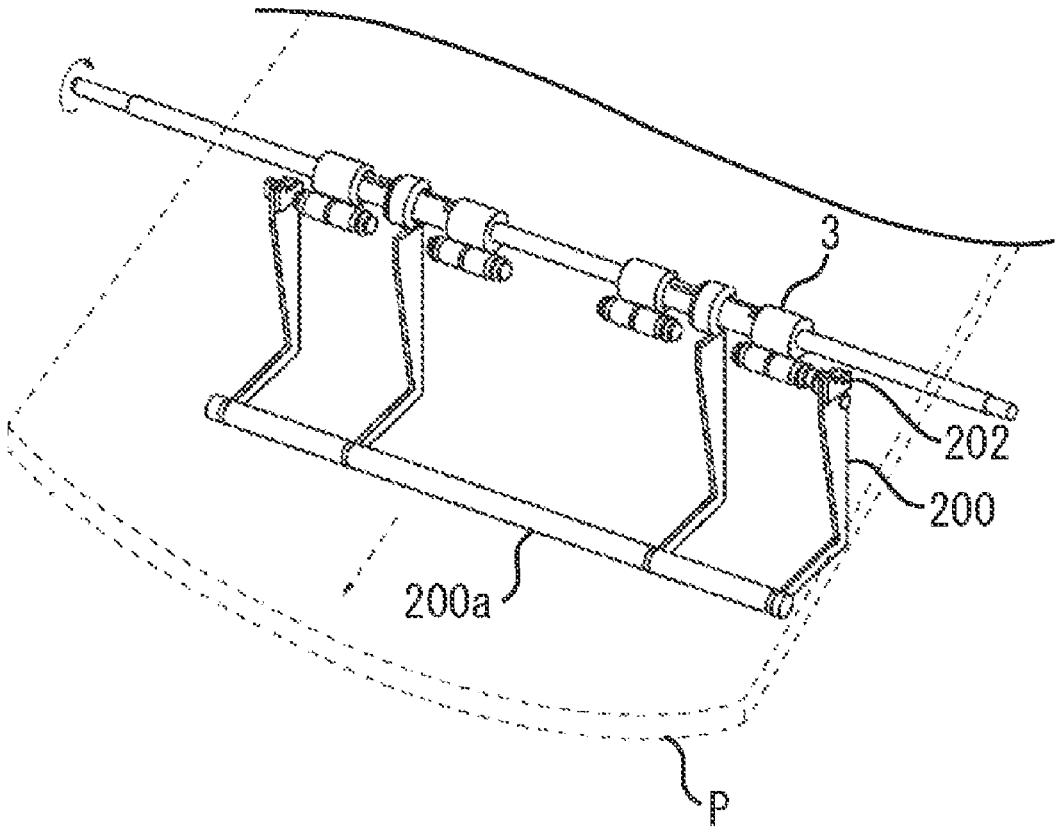
FIG. 5 is a perspective view illustrating a stiffness applying state of the sheet stacking apparatus according to the exemplary embodiment of the present invention.

As described above, when the sheet stacking amount is small, the stiffness applying rib 202 is at the protruding position which protrudes into a discharge path of the sheet P. Therefore, when the sheet P leaves the nip portion of the sheet discharge roller pair 3, the stiffness applying rib 202 abuts on the sheet P. Accordingly, as illustrated in FIG. 5, the sheet P is provided with stiffness and discharged in a gutter (concave) shape by the stiffness applying rib 202 and the sheet discharge roller pair 3. Thus, even a thin sheet with a weak stiffness is discharged onto the sheet discharge tray 4 without curling up or buckling.

Figure 6:
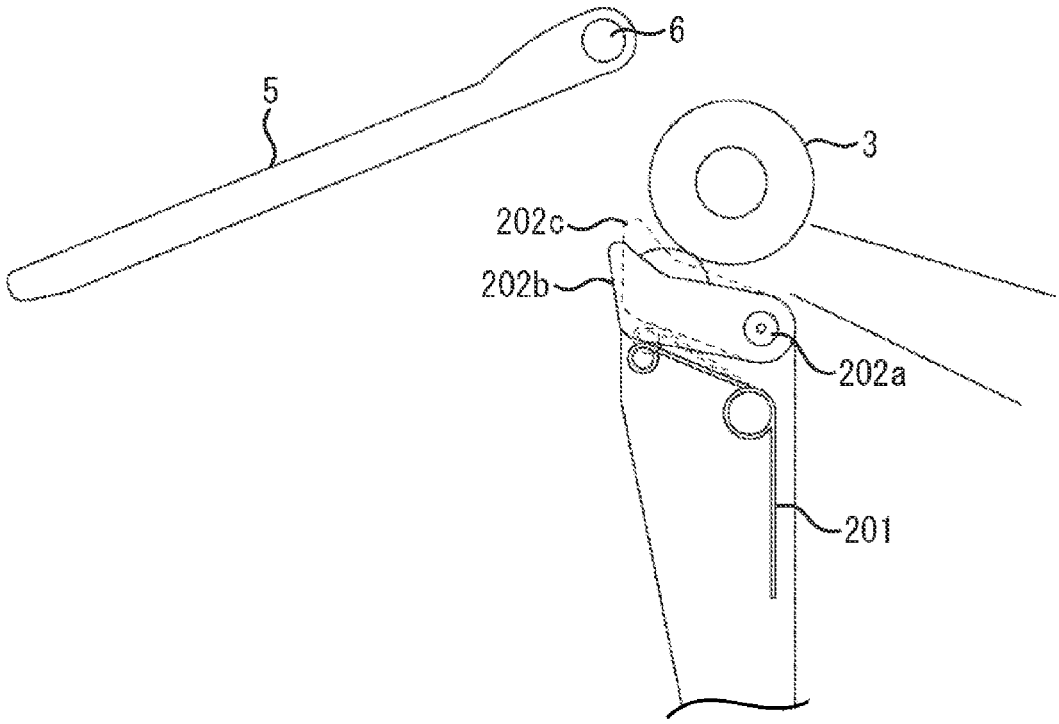
FIG. 6 is a cross sectional view illustrating an operation of a stiffness applying rib of the sheet stacking apparatus according to the exemplary embodiment of the present invention when a stiff thick sheet of paper is discharged.

A case where the sheet to be discharged is a thick sheet of paper with strong stiffness will be described using FIG. 6. If a sheet P with strong stiffness is fed to the sheet discharge roller pair 3, the stiffness applying rib 202 is rotated from a position 202*c* indicated by a dotted line to a position 202*b* indicated by a solid line around the rotating shaft 202*a* by the stiffness (warping reaction force) of the sheet P. When the sheet stacking amount is small, the stiffness applying rib 202 is held by the urging spring 201 at the protruding position which protrudes into the discharge path of the sheet P. The spring force of the urging spring 201 is set such that the stiffness applying rib 202 is retracted to the position 202*b* which is a retraction position out of the discharge path by the stiffness of the sheet P, when the thick sheet of paper is discharged. Therefore, in the case of a thick sheet of paper, the stiffness applying effect of the stiffness applying rib 202 is not exercised.

Further, during the process in which the sheet stacking amount reaches the full state, the stiffness applying rib 202 provided on the lever 200 which rotates by the weight of the sheets stacked on the sheet discharge tray 4 also rotates, so that when the sheet stacking amount is near the full state, the stiffness applying rib 202 is retracted from the discharge path of the sheet P. Thus, damage to the sheet caused by unnecessarily applied stiffness can be prevented, undesirable noise caused by rubbing the sheet P with the stiffness applying rib 202 during discharge of the sheet P can be reduced, and pushing out of the already stacked sheet due to rubbing of the sheet P against the already stacked sheet can be prevented.

Figure 7:
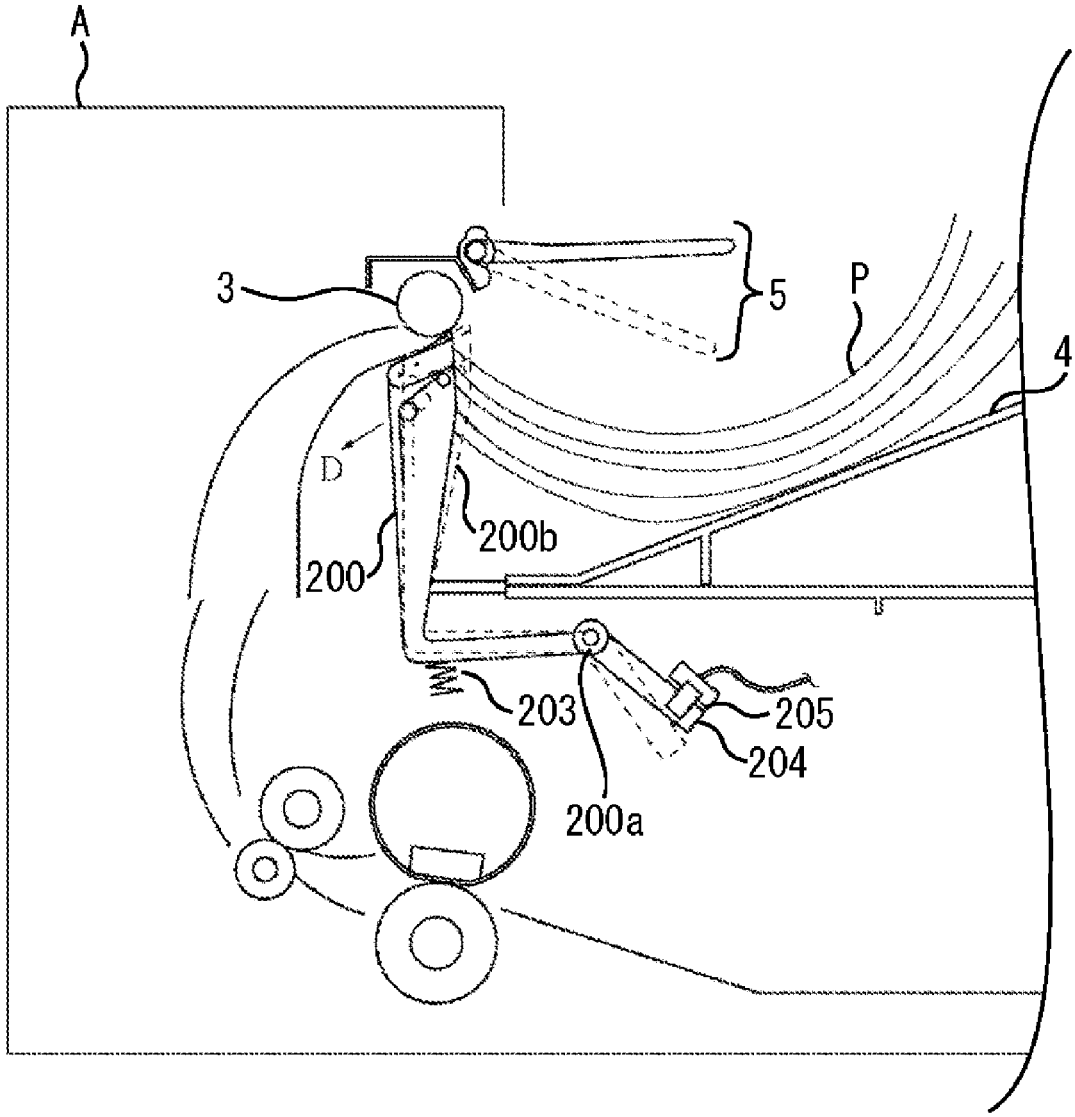
FIG. 7 is a cross sectional view illustrating a sheet leaning detection in the sheet stacking apparatus according to the exemplary embodiment of the present invention when the sheet curls in a sheet conveyance direction.

Next, as illustrated in FIG. 7, a case where the sheet P is greatly curled in the sheet conveyance direction will be described. If curled sheets P are successively stacked on the sheet discharge tray 4, the upstream side of the sheet P in the sheet conveyance direction leans on the lever 200, so that the sheets P blocks the sheet discharge port of the sheet discharge roller pair 3 before reaching the maximum stackable number of sheets. At this time, it is difficult for the full-state detection sensor lever 5 to detect a state that the stacked sheets block the sheet discharge port, as illustrated in FIG. 7.

However, since curled sheets P are abutted against the lever 200 at a position distant from the sheet discharge port of the sheet discharge roller pair 3, the weight of the sheets P of a leaning state affects as a greater moment than a normal stacking state. Therefore if a number of sheets P leaning on the lever 200 at the upstream side in the sheet conveyance direction reaches a certain level, the lever 200 is pressed by the weight of the sheets P and starts rotating in the direction of an arrow D around the rotating shaft 200*a* as the rotational center. At this stage, the spring 203 generates the urging force in the opposite direction to the arrow D against the weight of the sheets P at which the lever 200 starts rotating. By adjusting the reaction force of the spring 203, a number of stacking sheets P at which the lever 200 starts rotating is determined.

The number of stacking sheets P may be set at a level at which the leaning sheets P do not block the sheet discharge port of the sheet discharge roller pair 3. The lever 200 is rotated by the sheets P which has reached the predetermined number of stacking sheets and leans thereon. The rotation of the lever 200 is detected by the lever detection sensor 205 based on the leaning detection flag 204 which is provided integrally with the rotating shaft 200*a* which is the rotational center. Then, a message which prompts a user to remove the stacked sheets on the sheet discharge tray 4 is displayed. Further, as described above, since the rotating shaft 200*a* of the lever 200 is arranged at the position distant from the sheet discharge port of the sheet discharge roller pair 3, the weight of the sheets P stacked near the sheet discharge port largely affects the rotational force as the moment. Thus, detection of a sheet leaning state in which the weight of the sheets P affects the position distant from the rotating shaft 200*a* of the lever 200 can be performed more sensitively than a normal stacking state. Further, regarding the arm portion 200*b* of the lever 200, the surface abutting on the stacked sheets near the sheet discharge port is set at an angle which is more susceptible to the effect of the weight of the stacked sheets than the abutting surface near the sheet stacking surface. More specifically, the surface abutting on the stacked sheets near the sheet discharge port is set at an angle close to an angle orthogonal to an incline of the inclined portion of the sheet discharge tray 4. Thus, the weight component of the stacked sheets in the direction of the incline of the inclined portion of the sheet discharge tray 4 largely contributes to the rotational force of the lever 200 as the moment.

By configuring the lever 200 in this manner, problems such as folding, damaging, or falling down of a discharged sheet from the sheet discharge tray can be prevented in advance even if a sheet showing large curls that cannot be detected by a conventional full-state sensor lever is used. Further, failure of the apparatus due to gross jam can also be prevented.

Based on the detection results of sensors detecting two positions, the lever 200 and the full-state detection sensor lever 5, the control unit of the main body of the laser printer A determines whether the stacking state is detected as the full state of normal stacking or as abnormal stacking by curling and the like.

Figure 8:
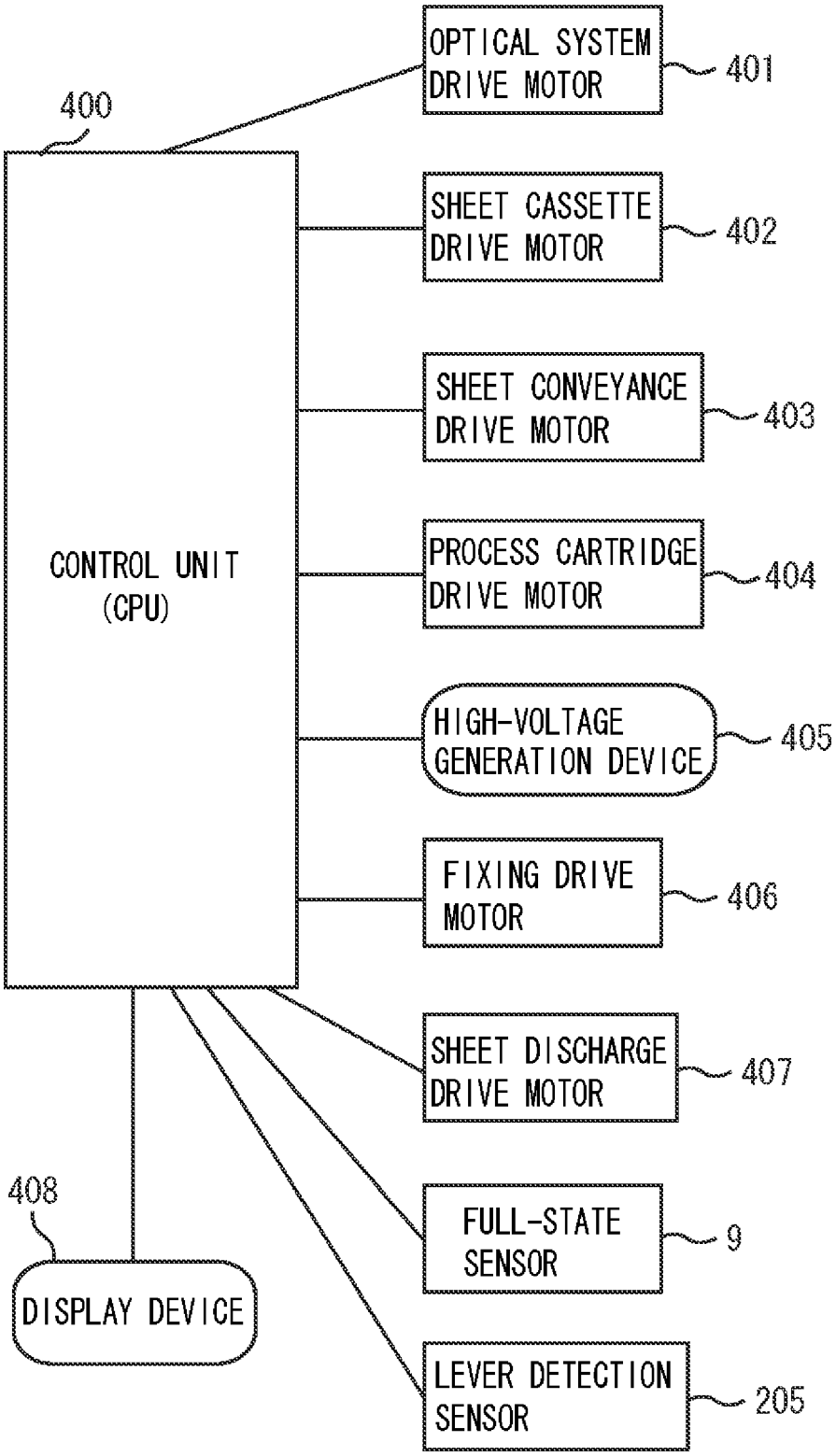
FIG. 8 is a block diagram illustrating control of the image forming apparatus according to the exemplary embodiment of the present invention.

FIG. 8 is a diagram illustrating the control blocks of the control unit of the main body of the laser printer A. A CPU 400 constituting the control unit is connected to an optical system drive motor 401 which performs laser irradiation for forming an image based on an instruction from the CPU 400. A process cartridge drive motor 404 which drives the process cartridge 101 that constitutes the image forming unit and a high-voltage generation device 405 which generates a bias voltage for image formation are respectively connected to the CPU 400. The process cartridge drive motor 404 and the high-voltage generation device 405 control the image formation process. A display device 408, which is a display unit, displays various warnings and messages based on an input signal from the CPU 400. Further, a sheet discharge drive motor 407, a fixing drive motor 406, a sheet conveyance drive motor 403, and a sheet cassette drive motor 402 are connected to the CPU 400. These motors perform various conveyance controls of the sheet material. In addition, detection signals from the above-described full-state detection sensor 9 and lever detection sensor 205 are input in the CPU 400. The stacking state of the sheets stacked on the sheet discharge tray 4 is determined based on the detection signals.

Figure 9:
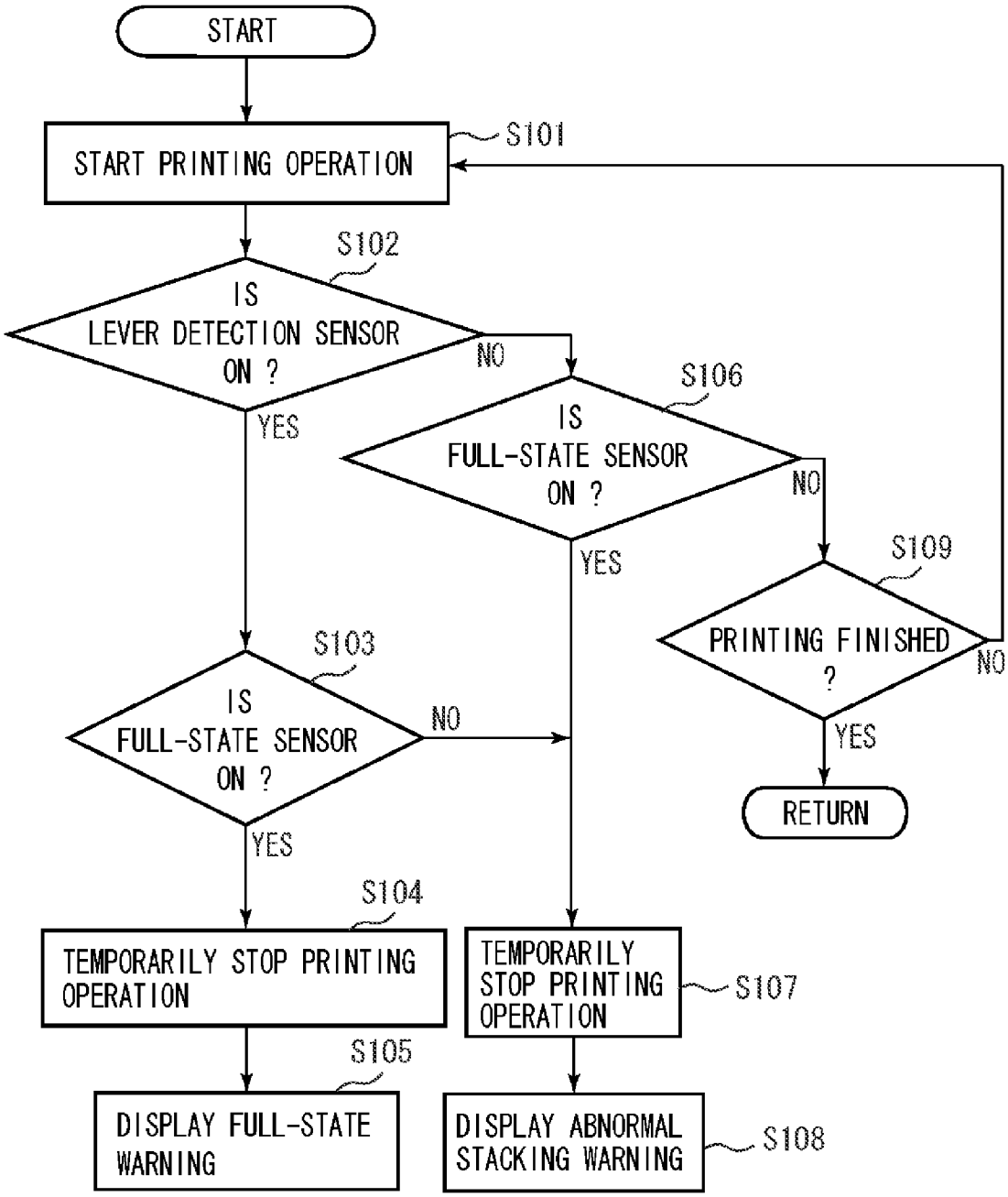
FIG. 9 illustrates a flowchart for detecting a full-state according to the exemplary embodiment of the present invention.
Figure 10:
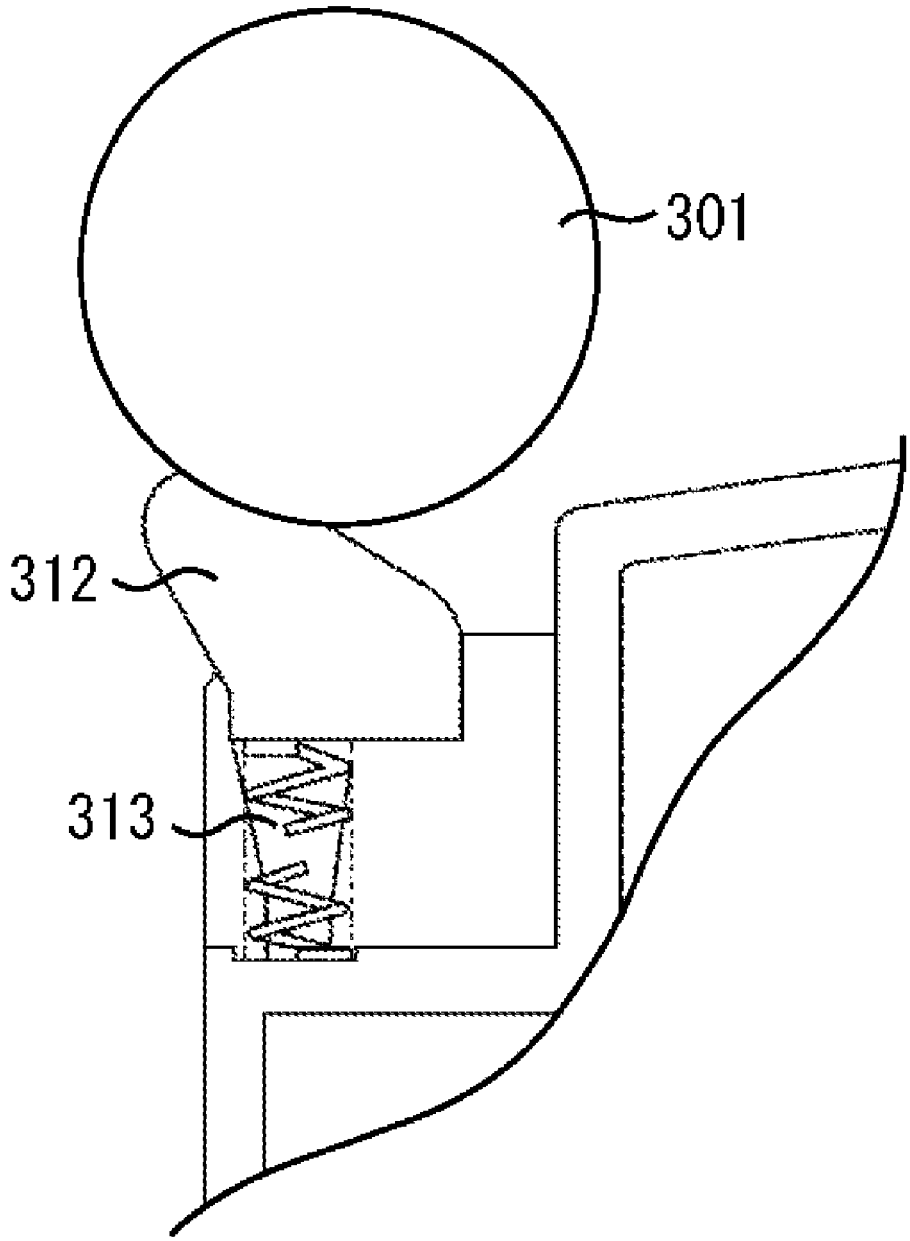
FIG. 10 is a cross sectional view of a conventional sheet stacking apparatus.
Figure 11:
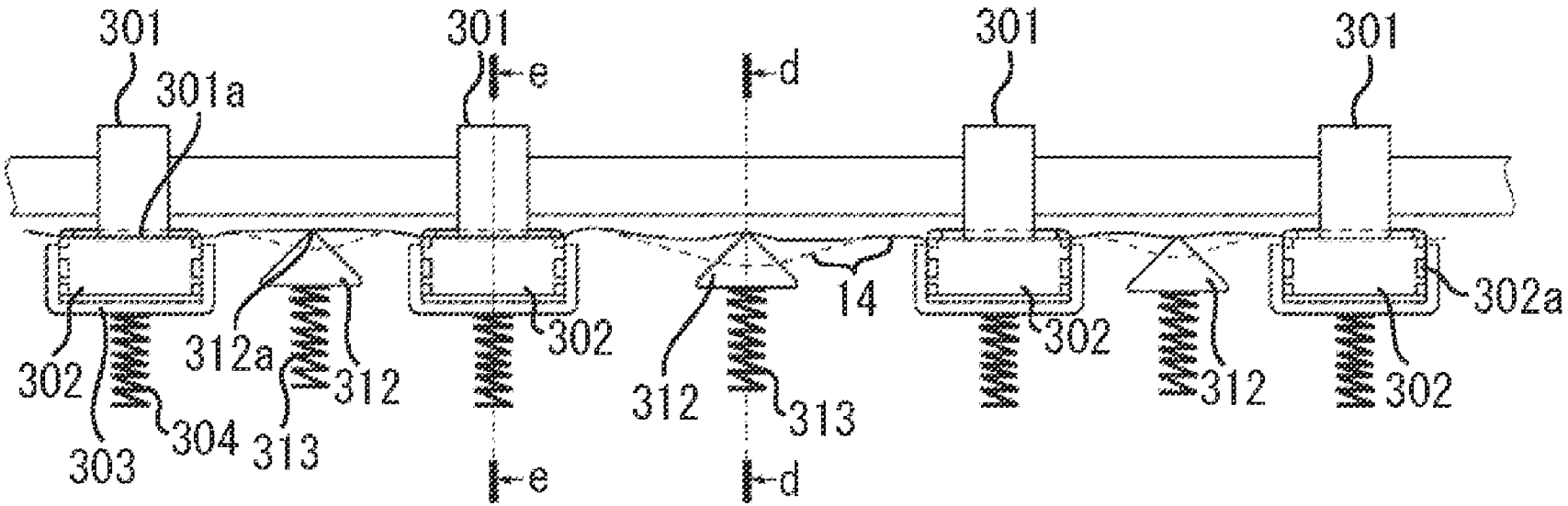
FIG. 11 is a schematic view of the conventional sheet stacking apparatus.

The flowchart illustrated in FIG. 9 will be described based on the above control unit configuration.

In step S101, the print operation starts based on an image output signal from the host computer (not-illustrated). In step S102, the control unit of the main body of the laser printer A confirms the presence of rotation of the lever 200. If rotation of the lever 200 is confirmed (YES in step S102), the processing proceeds to step S103. Instep S103, the control unit confirms whether the sheet stacking amount is in a full state. If the sheet stacking amount is determined as the full state (YES in step S103), the processing proceeds to step S104. In step S104, the control unit temporarily stops the print operation. Then, in step S105, a warning to remove the stacked sheets on the sheet discharge tray 4 is displayed on an operation unit. In step S103, if the sheet stacking amount is determined not to be in the full state (NO in step S103), the processing proceeds to step S107. In step S107, since there is a possibility that "leaning stacking" has occurred in which the stacked sheets lean on the sheet discharge port due to curling in the sheet conveyance direction, the control unit temporarily stops the print operation (step S107). Then, in step S108, the warning is displayed (step S108). As a result, the pushing out and falling off of the sheet from the sheet discharge tray 4 due to over-stacking can be prevented, and stacking defects such as leaning stack due to curling can be notified to the user.

On the other hand, in step S102, if rotation of the lever 200 is not confirmed (NO in step S102), the processing proceeds to step S106. In step S106, the control until confirms whether the sheet stacking amount is in the full state. If the sheet stacking amount is determined as the full state (YES in step S106), the processing proceeds to step S107. In step S107, since there is a possibility that a foreign object has been placed on the sheet discharge tray 4, the control unit temporarily stops the print operation. Then, in step S108, the warning is displayed. In step S106, if the sheet stacking amount is determined not to be in the full state (NO in step S106), the control unit determines that normal sheet stacking is being performed, and the processing proceeds to step S109. In step S109, the control unit determines whether printing is finished. More specifically, if the sheet is not the last page (NO in step S109), the processing returns to step S101, and starts the print operation. If the sheet is the last page (YES in step S109), the processing finishes.

According to the present exemplary embodiment, since the stiffness applying rib 202 which abuts on the sheet to be discharged to apply stiffness thereto is provided on the lever 200 which rotates by the weight of the sheets stacked on the sheet discharge tray 4, good alignment property and stacking property can be realized regardless of the sheet stacking amount.

Further, while the present invention is described based on the above exemplary embodiment, the present invention is not limited to the above configuration.

In the above exemplary embodiment, although a configuration is described in which the stiffness applying rib 202 is integrally provided on the lever 200, the stiffness applying rib 202 and the lever 200 may be provided separately, so long as a deforming amount applied by the stiffness applying rib 202 can be changed in conjunction with the movement of the lever 200.

Further, in the above exemplary embodiment, while a configuration is described in which the stiffness applying rib 202 is retracted from the discharge path of the sheet P when the sheet stacking amount is in the full state, the stiffness applying rib 202 may abut on the sheet to be discharged so long as abutting does not cause resistance thereagainst.

In addition, in the above exemplary embodiment, although a sheet stacking apparatus is described which is mounted on an image forming apparatus such as a copying machine, a printer, and a facsimile machine, the present invention may be applied to a finisher which is separately connected to the image forming apparatus as a sheet processing apparatus. In such a case, the finisher may be directly controlled by the control unit (CPU) mounted on the main body of the laser printer A, or the finisher may be controlled by a finisher control unit which is provided on the finisher side via a network.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-141059 filed May 29, 2008, and No. 2009-116608 filed May 13, 2009, which are hereby incorporated by reference herein in their entirety.

What is claimed is:

1. A sheet stacking apparatus comprising:

a discharging portion configured to discharge a sheet;

a stacking portion configured to stack the discharged sheet;

a lever member movable with an increase in the stacking amount of the sheets stacked on the stacking portion; and a deforming member, provided on the lever member to protrude into a discharge path of the sheet discharged by the discharging portion, which deforms the sheet to press a surface of the sheet being discharged by the discharging portion, and which decreases a deformation amount of the sheet based on a movement of the lever member that is moved as a stacking amount of the sheets stacked on the stacking portion increases.

2. The sheet stacking apparatus according to claim 1, wherein the deforming member is provided on the lever member rotatably, and is urged by an elastic member in a direction protruding into a discharge path of the sheet to be discharged.

3. The sheet stacking apparatus according to claim 1, further comprising:

a first detection portion configured to generate a signal when the sheets stacked on the stacking portion reach a predetermined stacking height; and a second detection portion configured to generate a signal when the lever member is pressed by the stacked sheets and moves to a predetermined position, wherein a stacked state of the sheets stacked on the stacking portion is determined as abnormal stacking when the first detection portion does not generate a signal and the second detection portion generates a signal.

4. The sheet stacking apparatus according to claim 1, wherein the plural deforming members are arranged in a sheet width direction which is orthogonal to the sheet discharge direction to press the sheet being discharged by the discharging portion.

5. An image forming apparatus comprising:

an image forming unit configured to form an image on a sheet; and a sheet stacking apparatus configured to stack a sheet on which an image is formed, the sheet stacking apparatus comprises:

a discharging portion configured to discharge a sheet;

a stacking portion configured to stack the discharged sheet;

a lever member movable with an increase in the stacking amount of the sheets stacked on the stacking portion; and a deforming member, provided on the lever member to protrude into a discharge path of the sheet discharged by the discharging portion, which deforms the sheet to press a surface of the sheet being discharged by the discharging portion, and which decreases a deformation amount of the sheet based on a movement of the lever member that is moved as a stacking amount of the sheets stacked on the stacking portion increases.

6. The image forming apparatus according to claim 5, wherein the deforming member is provided on the lever member rotatably, and is urged by an elastic member in a direction protruding into a discharge path of the sheet to be discharged.

7. The image forming apparatus according to claim 5, further comprising:

a first detection portion configured to generate a signal when the sheets stacked on the stacking portion reach a predetermined stacking height; and a second detection portion configured to generate a signal when the lever member is pressed by the stacked sheets and moves to a predetermined position, wherein a stacked state of the sheets stacked on the stacking portion is determined as abnormal stacking when the first detection portion generates a signal and the second detection portion does not generate a signal.

8. The image forming apparatus according to claim 5, wherein the plural deforming members are arranged in a sheet width direction which is orthogonal to the sheet discharge direction.

* * * * *